US006387180B1

(12) United States Patent
Takahashi et al.

(10) Patent No.: US 6,387,180 B1
(45) Date of Patent: May 14, 2002

(54) COATING APPARATUS

(75) Inventors: Susumu Takahashi; Haruhiro Iida; Hirofumi Yamamoto, all of Osaka (JP)

(73) Assignee: Inoue Kinzoku Kogyo Co., Ltd., Osaka (JP)

( * ) Notice: Subject to any disclaimer, the term of this patent is extended or adjusted under 35 U.S.C. 154(b) by 0 days.

(21) Appl. No.: 09/469,787

(22) Filed: Dec. 22, 1999

(30) Foreign Application Priority Data

Dec. 24, 1998 (JP) ..... 10-366240

(51) Int. Cl.[7] ..... B05C 1/00; B05C 13/00

(52) U.S. Cl. ..... 118/216; 118/500; 118/227; 118/249; 118/262; 101/479

(58) Field of Search ..... 118/500, 258, 118/235, 200, 234, 244, 249, 262, 209, 232, 233, 216, 217, 218, 220; 101/479, 216; 384/24, 416, 418; 427/428

(56) References Cited

U.S. PATENT DOCUMENTS 5,601,021 A * 2/1997 Katabira et al. ..... 102/218
5,620,515 A * 4/1997 Takahashi et al. ..... 118/258
5,771,805 A * 6/1998 Branas et al. ..... 101/248
5,832,829 A * 10/1998 Kolbe et lal. ..... 101/352.01

* cited by examiner

*Primary Examiner*—Laura Edwards
*Assistant Examiner*—Yewebdar T Tadesse
(74) *Attorney, Agent, or Firm*—Wenderoth, Lind & Ponack, L.L.P.

(57) ABSTRACT

A coating apparatus has compact coating assembly modules which require less storage space and are easier to handle and which through the common use of parts and accessory tools provide a reduced manufacturing cost of the apparatus as a whole. A coating assembly which rotates during coating and a coating assembly which does not rotate during coating can be interchangeably installed to a support frame. Two bearing cases are mounted on the support frame, and the coating assemblies each have two shaft parts which can be removably set in the bearing cases. The shaft parts of the rotating coating assembly can be rotatably set in the bearing cases, and a shaft part of the non-rotating coating assembly can, when set in its corresponding bearing case, be anchored to a fixed part so that it cannot rotate. Another coating assembly which does not rotate during coating has left and right mounting parts which can be removably fixed to bearing cradle parts of the bearing cases.

10 Claims, 14 Drawing Sheets

COATING APPARATUS

BACKGROUND OF THE INVENTION

1. Field of the Invention

This invention relates to an improvement to a coating apparatus in which, so that any of a plurality of coating modes can be selected, a plurality of coating assemblies corresponding to different coating modes can be installed interchangeably.

2. Prior Art

An example of a conventional coating apparatus with which any of a plurality of coating modes can be selected is described in "Coating and Laminating Machine", published by the Process Technology Research AssociationLtd. This coating apparatus, as shown in FIG. 14, is made up of a fixed unit 1, which is fixed at a coating station, and a plurality of module units 2, 3 which can be brought to a predetermined position in the fixed unit 1.

The fixed unit 1 has a support frame 4, guide rollers 5, 5 mounted on the support frame 4, and backup rollers 6 mounted vertically movably on the support frame 4.

The module unit 2 has a mobile frame 7, a gravure roller 8 mounted on the mobile frame 7, and accessory tools such as a doctor 9 mounted on the mobile frame 7, and is equipped for gravure coating. The module unit 3 has a mobile frame 10, a coating roller 11 and a metering roller 12 mounted on the mobile frame 10, and accessory tools such as a gap adjuster 13 provided between the moving frame 10 and the metering roller 12, and is equipped for reverse roll coating. Modules corresponding to other coating modes besides these (for example knife coating, die coating and so on) are also provided, and where necessary each module has a gap adjuster.

However, because the module unit 2 (or 3) has a large mobile frame 7 (or 10), a large space is required to store it, and because its overall weight is heavy it is difficult to handle. And, because the module unit 2 (or 3) will use some parts and accessories which are common to all module units, such as bearings and gap adjusters and so on, there is duplication of parts and accessories among the module units as a whole and consequently their overall manufacturing cost is high.

SUMMARY OF THE INVENTION

It is therefore an object of the present invention to provide a coating apparatus having compact coating assembly modules which require less storage space and are easier to handle and which through the common use of parts and accessory tools provide a reduced manufacturing cost of the apparatus as a whole.

To reduce numbers of parts and make coating assemblies more compact by promoting the common use of parts, the invention provides a coating apparatus, wherein a plurality of coating assemblies can be interchangeably installed to a support frame, comprising: a support frame; two bearing cases mounted on the support frame; and a coating assembly which rotates during coating and a coating assembly which does not rotate during coating, the coating assemblies each having two shaft parts which can be removably set in the bearing cases, wherein the shaft parts of the coating assembly which rotates can be set in the bearing cases rotatably and the shaft parts of the coating assembly which does not rotate can be anchored to a fixed part so that they cannot rotate when set in the bearing cases.

Interchanging of the coating assemblies can be carried out by the shaft parts of the coating assemblies being set in and removed from the two bearing cases. Also, as a result of the coating assemblies using bearing cases mounted on the support frame commonly, it becomes unnecessary for each of the coating assemblies to have bearing cases or mounting assemblies, and the coating assemblies can be made more compact and lighter in weight.

To make it possible for fixing of a coating assembly which does not rotate during coating to be effected surely and to enable the angular position of such a coating assembly to be adjusted when coating is not in progress, preferably the coating assembly which does not rotate has a fixing assembly which can be fitted and tightened on one of the shaft parts of that coating assembly and anchored to a fixed part of one of the bearing cases so that when the fixing assembly is tightened, the coating assembly cannot rotate and when the fixing assembly is not tightened, the angular position of that coating assembly can be adjusted.

In this case, because a shaft part of the coating assembly is anchored to a fixed part of a bearing case by a tightened fixing assembly, the coating assembly can be kept firmly fixed during coating and the coating assembly can rotationally adjusted by the fixing assembly being loosened.

To make it possible for interchanging of coating assemblies to be carried out quickly, preferably, the bearing cases each have a bearing cradle part mounted on the support frame and a bearing cover part separably joined to the bearing cradle part; and the shaft parts of either of the coating assemblies can be held by the bearing cradle part and the bearing cover part in their joined state.

In this case, the shaft parts of either of the coating assemblies can be held in the bearing cases by the bearing cradle parts and the bearing cover parts being joined, and the shaft parts of the coating assembly can be removed from the bearing cases by the bearing cover parts being separated from the bearing cradle parts.

To make it possible to mount to the bearing cases a coating assembly not having shaft parts, preferably, the apparatus further comprises another coating assembly which does not rotate during coating, and this coating assembly has mounting parts which can be removably fixed to the bearing cradle parts.

In this case, it is possible to mount the coating assembly to the bearing cases by fixing the mounting parts of the coating assembly to the bearing cradle parts with the bearing cover parts removed.

To commonize the sliding mechanisms, the bearing cases are preferably mounted on sliders provided slidably back and forth on the support frame.

In this case, because mechanisms for allowing the bearing cases to slide are provided on the support frame side, sliding adjustment of the coating assembly mounted on the bearing cases can be carried out using these mechanisms and it is not necessary for sliding mechanisms to be provided on the coating assemblies.

To reduce the number of parts and make the coating assemblies more compact by promoting the common use of parts, the invention also provides another coating apparatus, wherein a plurality of coating assemblies can be interchangeably installed to a support frame, comprising: a support frame; a slider provided on the support frame so as to be able to advance and retreat; a gap adjuster for adjusting a stopping position of the slider; and a plurality of coating assemblies each having a frame which can be removably fixed to the slider.

Interchanging of the coating assemblies can be carried out by the frames of the coating assemblies being fixed to the slider provided on the support frame. Also, as a result of the coating assemblies using the slider and the gap adjuster commonly, it becomes unnecessary for the coating assemblies to be provided with sliders and gap adjusters, and the coating assemblies can be made lighter.

FIRST PREFERRED EMBODIMENT

Figure 1:
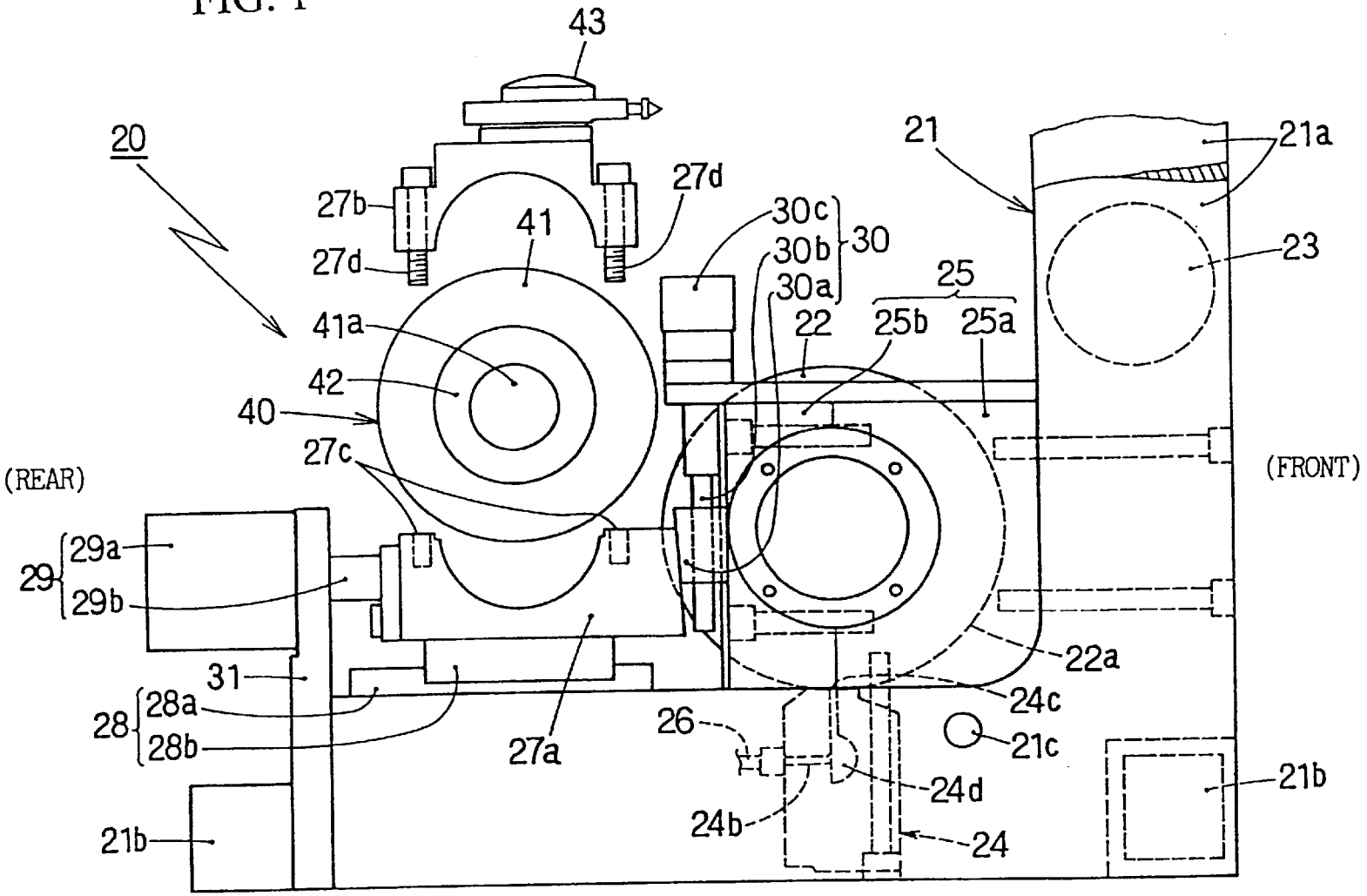
FIG. 1 is a right side view of a first preferred embodiment of a coating apparatus according to the invention and shows a coating assembly having a metering roller, which rotates during coating, removed from bearing cases.

FIG. 1 through FIG. 10 show a first preferred embodiment of the coating apparatus of the invention.

The coating apparatus 20 has a support frame 21 fixed in a predetermined location, a backing roller 22 and a guide roller 23 rotatably mounted on the support frame 21, a fountain applicator 24 mounted on the support frame 21 so that it faces the backing roller 22, and coating assemblies 40, 50 and 60 which can be mounted interchangeably on the support frame 21. The support frame 21 has left and right side frame members 21*a*, 21*a* (see FIG. 3, FIG. 6) connected by connecting frame members 21*b*, 21*b*. The support frame 21 can be fixed directly or by way of a frame (not shown) to an installation floor, or support pins 21*c*, 21*c* (see FIG. 1 through FIG. 3) provided on the left and right side frame members 21*a*, 21*a* can be supported on a frame (not shown) rotatably so that the support frame 21 can be fixed at a suitable angle corresponding to a coating mode.

The backing roller 22 has shaft parts at its ends supported by bearing cases 25 mounted on the left and right side frame members 21*a*, 21*a* and is forcibly driven by a driving coupling (not shown) connected to one of the shaft parts. The bearing cases 25 are each made up of a bearing cradle part 25*a*mounted on the side frame 21*a* and a bearing cover part 25*b* joined separably to the bearing cradle part 25*a* so that the backing roller 22 can be removed.

The fountain applicator 24, as shown in FIG. 1, has a coating liquid passage 24*b* provided inside an applicator body 24*a*, a coating liquid delivery slit 24*c* extending in the left-right direction at the downstream end of the coating liquid passage 24*b*, and a manifold 24*d* formed part-way along the coating liquid passage 24*b*, and coating liquid supplied through a coating liquid supply hose 26 connected to the upstream end of the coating liquid passage 24*b* is delivered through the coating liquid delivery slit 24*c* to the face 22*a* of the backing roller 22. Coating liquid delivered through the coating liquid delivery slit 24*c* coats the surface of a web W (see FIG. 2) being carried by the face 22*a* of the backing roller 22. While this is not shown in the drawings, the fountain applicator 24 can alternatively be replaced with an applicator roller for raising coating liquid from a coating liquid pan.

Bearing cases 27 for interchangeably mounting the coating assemblies 40, 50 and 60 are mounted by way of slider mechanisms 28 on the left and right side frame members 21*a*, 21*a* of the support frame 21. Each of the slider mechanisms 28 is made up of a guide rail 28*a* attached to the side frame 21*a* and a slider 28*b* slidably guided on the guide rail 28*a*. Each of the bearing cases 27 is made up of a bearing cradle part 27*a* mounted on the slider 28*b* and a bearing cover part 27*b* separably joined to the bearing cradle part 27*a*. Joining and separating of the bearing cover parts 27*b* with respect to the bearing cradle parts 27*a* is carried out by screw-fixing of bolts 27*d*, 27*d* passing through holes in the bearing cover part 27*b* into threaded holes 27*c* provided in the bearing cradle parts 27*a*.

Actuators 29 for moving the bearing cases 27 in the front-rear direction and gap adjusters 30 for stopping the bearing cases 27 at a predetermined coating position are provided between the bearing cases 27 and the side frame members 21*a*. Each of the actuators 29 consists of an air cylinder or the like and has a body 29*a* mounted on the side frame 21*a* by way of a bracket 31 and a telescoping output shaft 29*b* connected to the bearing cradle part 27*a* of the bearing case 27. Each of the gap adjusters 30 has a taper cotter 30*a* disposed vertically slidably between the bearing cradle part 25*a* of the bearing case 25 and the bearing cradle part 27*a* of the bearing case 27, a bolt 30*b* screwed through the taper cotter 30*a*, and a rotational position controller 30*c* for rotating the bolt 30*b*; by operating the rotational position controller 30*c* it is possible to move the taper cotter 30*a* up or down and thereby control a gap formed between a coating assembly 40, 50 or 60 mounted to the bearing cases 27 and the face 22*a* of the backing roller 22.

The coating assemblies 40, 50 and 60, interchangeably installed on the support frame 21 by way of the bearing cases 27, have the following constructions.

Figure 2:
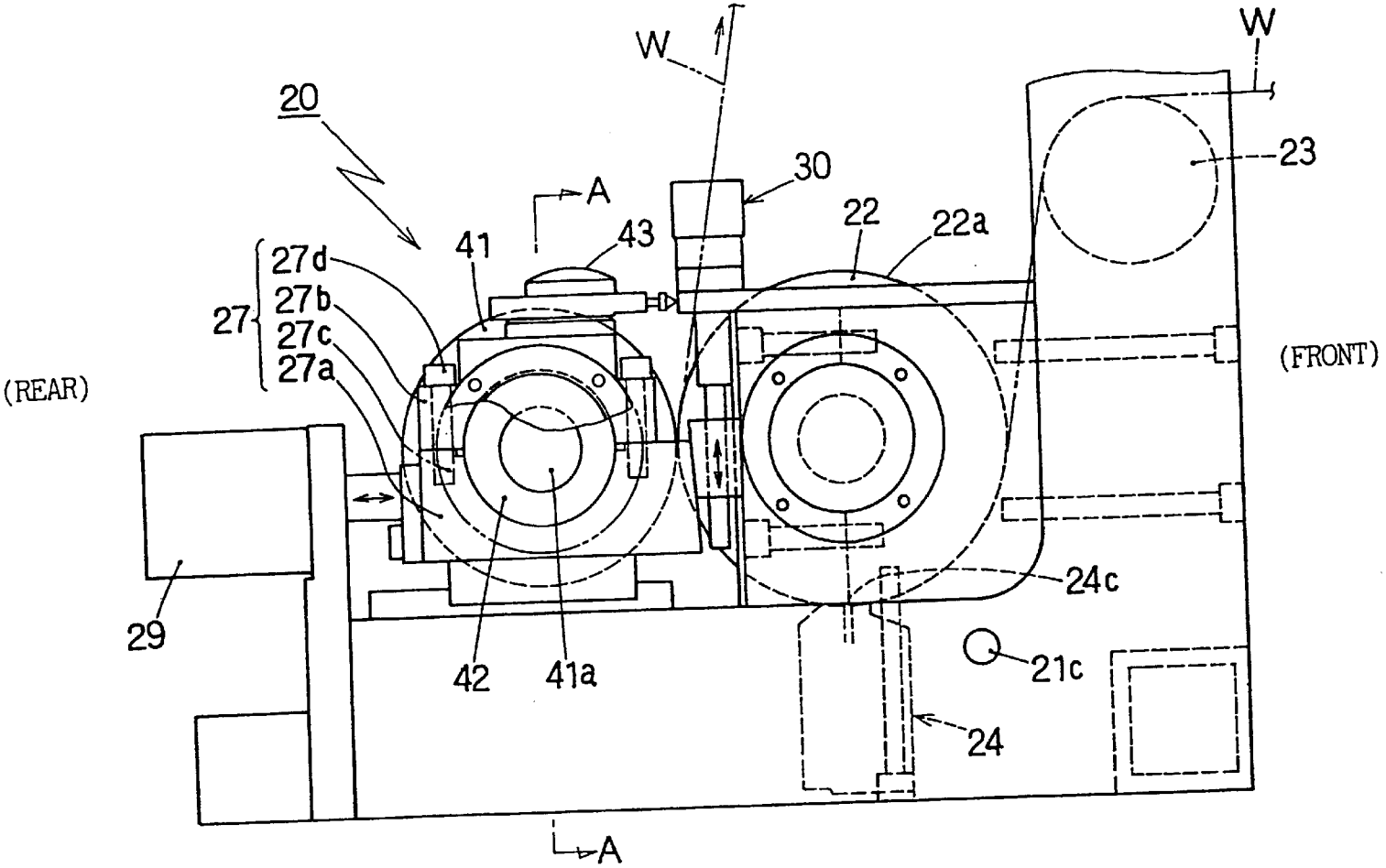
FIG. 2 is a right side view showing the same coating assembly set in the bearing cases.
Figure 3:
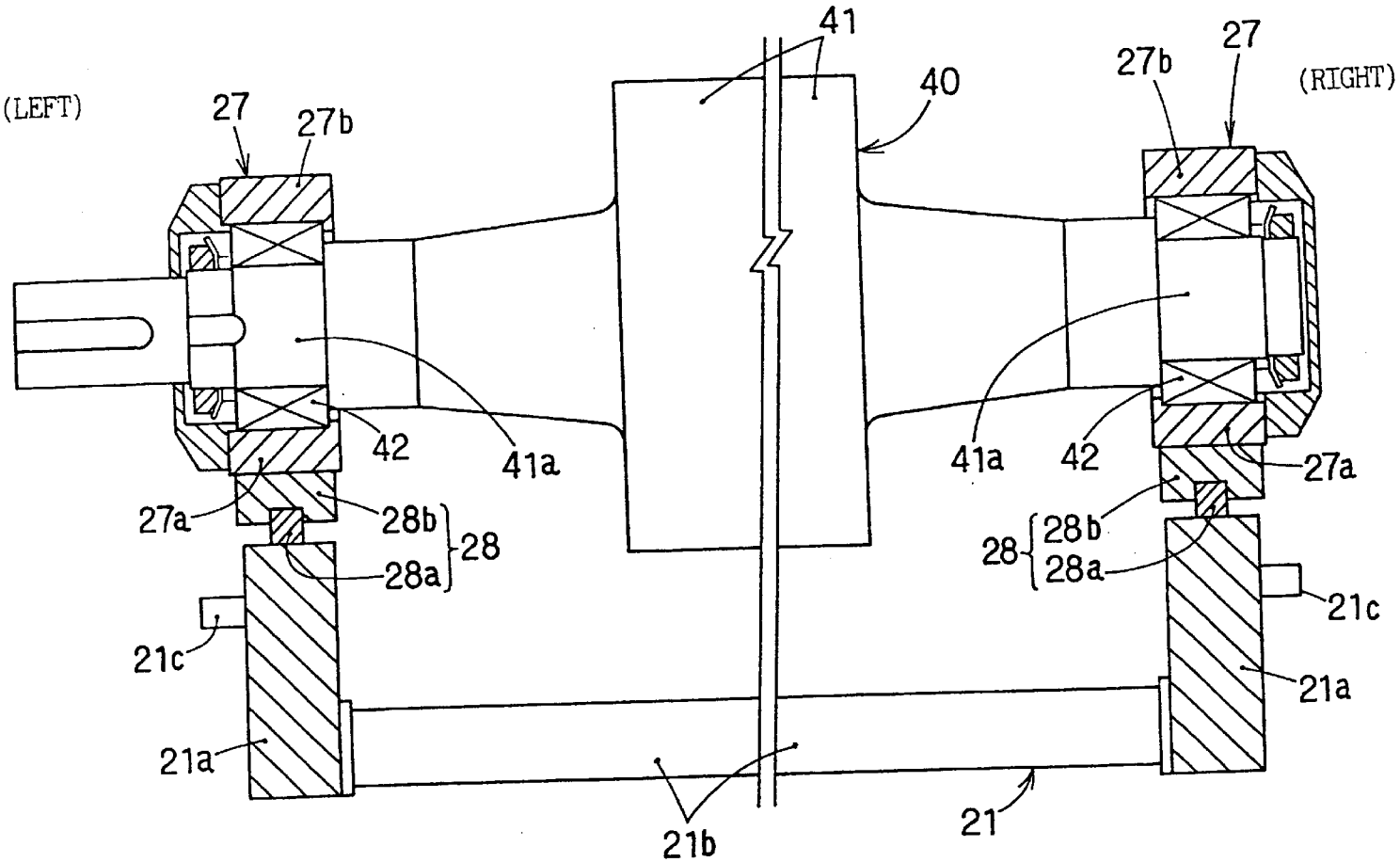
FIG. 3 is an enlarged sectional view, abbreviated in the middle, on the line A—A in FIG. 2.

The coating assembly 40, as shown in FIG. 1 through FIG. 3, has a metering roller 41, which rotates during coating, and bearings 42, consisting of ball bearings or the like, fitted to left and right shaft parts 41*a*, 41*a*. The coating assembly 40 is installed on the support frame 21 by the bearings 42 being held between the bearing cradle parts 27*a*and the bearing cover parts 27*b*, which are joined by the bolts 27*d* and 27*d*, of the bearing cases 27, and can be removed from the support frame 21 by the bearing cover parts 27*b* of the bearing cases 27 being separated from the bearing cradle parts 27*a*. By the metering roller 41 being forcibly rotated by a driving coupling (not shown) connected to the end of the shaft part 41*a* on a driven side, the coating assembly 40 installed on the support frame 21, as shown in FIG. 2, post-meters with the metering roller 41 a coated film formed by the fountain applicator 24 on the web W transported by the backing roller 22 and thereby brings the film to a predetermined film thickness. Adjustment of the thickness of the coated film is carried out by operating the gap adjusters 30 while looking at dial gauges 43 attached to the bearing cases 27.

Figure 4:
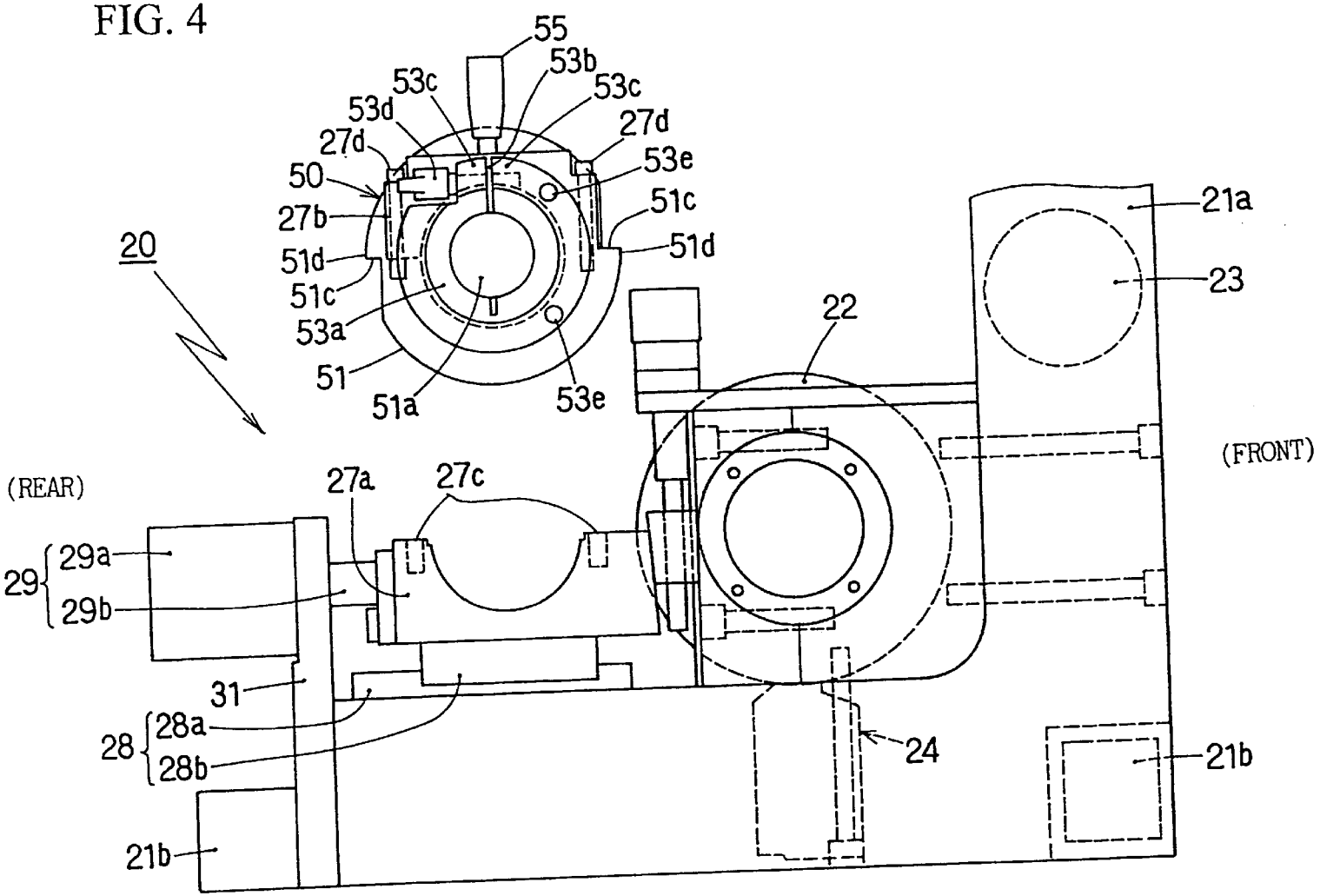
FIG. 4 is a right side view of the first embodiment showing a coating assembly having a doctor knife, which does not rotate during coating, removed from the bearing cases.
Figure 5:
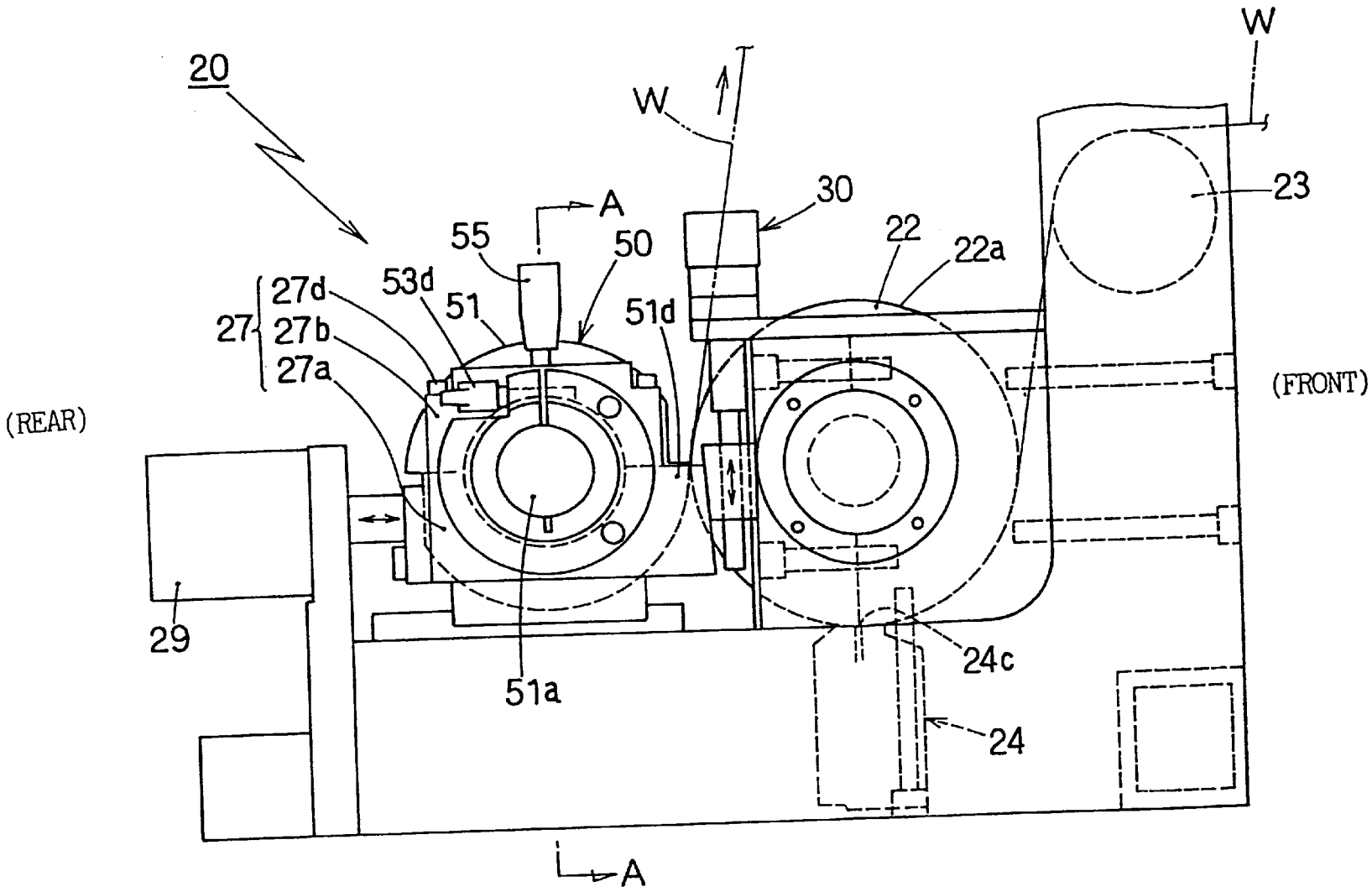
FIG. 5 is a right side view showing the same coating assembly set in the bearing cases.
Figure 6:
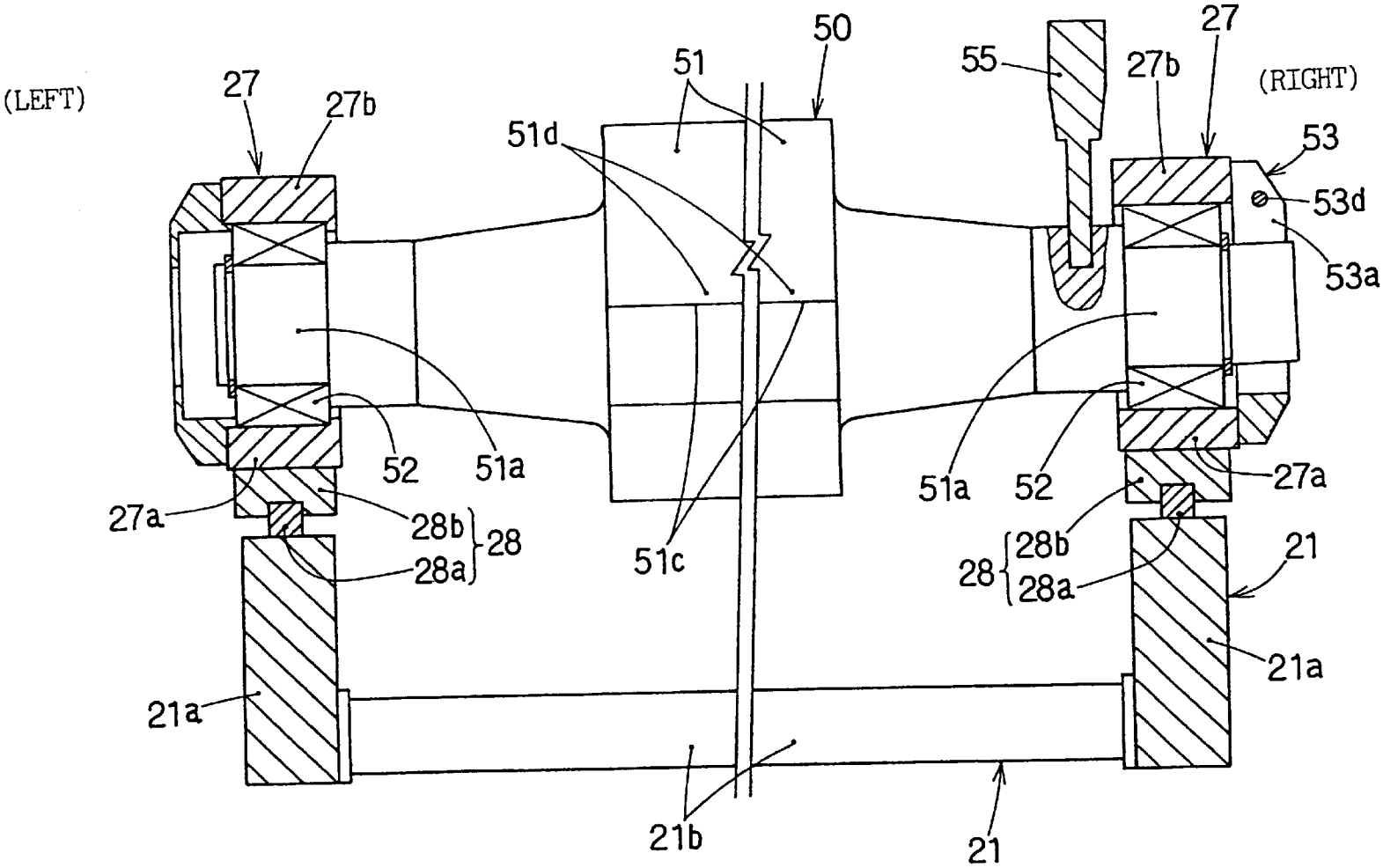
FIG. 6 is an enlarged sectional view, abbreviated in the middle, on the line A—A in FIG. 5.

The coating assembly 50, as shown in FIG. 4 through FIG. 6, has a doctor knife 51, which is fixed so that it cannot rotate during coating; bearings 52, 52 fitted to left and right shaft parts 51*a*, 51*a* of the doctor knife 51; and a fixing assembly 53, which can be fitted onto the shaft part 51*a* on an operating side and tightened and can be anchored to the bearing cradle part 27*a* and the bearing cover part 27*b* of the bearing case 27, which constitutes a fixed part. The doctor knife 51 has formed in two locations in the outside of a columnar body part 51*b* thereof a step 51*c* extending in the left-right direction and thus has two knife edge parts 51*d*, 51*d* for metering. The doctor knife 51 also has a handle 55 in the shaft part 51*a* on the operating side to facilitate rotation of the doctor knife 51 by an operator. The fixing assembly 53 has an annular body 53*a* fitting on the shaft part 51*a* of the doctor knife 51, a tightening screw 53*d* for forcing together two end parts 53*c*, 53*c* forming a split 53*b* in the body 53*a*, and screws 53*e*, 53*e* for anchoring the body 53*a* to the bearing case 27.

The coating assembly 50 is mounted to the support frame 21 by the bearings 52 being held in the bearing cradle parts 27*a* and the bearing cover parts 27*b*, joined by the bolts 27*d* and 27*d*, of the bearing cases 27, and the fixing assembly 53 being anchored to the bearing case 27 on the operating side with the screws 53*e*, 53*e*. It can be removed from the support frame 21 by the bearing cover parts 27*b* of the bearing cases 27 being separated from the bearing cradle parts 27*a* and the fixing assembly 53 being detached from the bearing case 27. When the coating assembly 50 is installed on the support frame 21, tightening the screw 53*d* of the fixing assembly 53 prevents the doctor knife 51 from rotating during coating, and loosening the tightening screw 53*d* of the fixing assembly 53 makes it possible to rotationally adjust the doctor knife 51.

As shown in FIG. 5, the coating assembly 50 installed on the support frame 21 post-meters with a knife edge part 51d of the doctor knife 51 a coated film formed by the fountain applicator 24 on the web W being transported by the backing roller 22 and thereby brings the film to a predetermined film thickness. Adjustment of the thickness of the coated film is carried out by operating the gap adjusters 30 while looking at the dial gauges 43 attached to the bearing cases 27.

Figure 7:
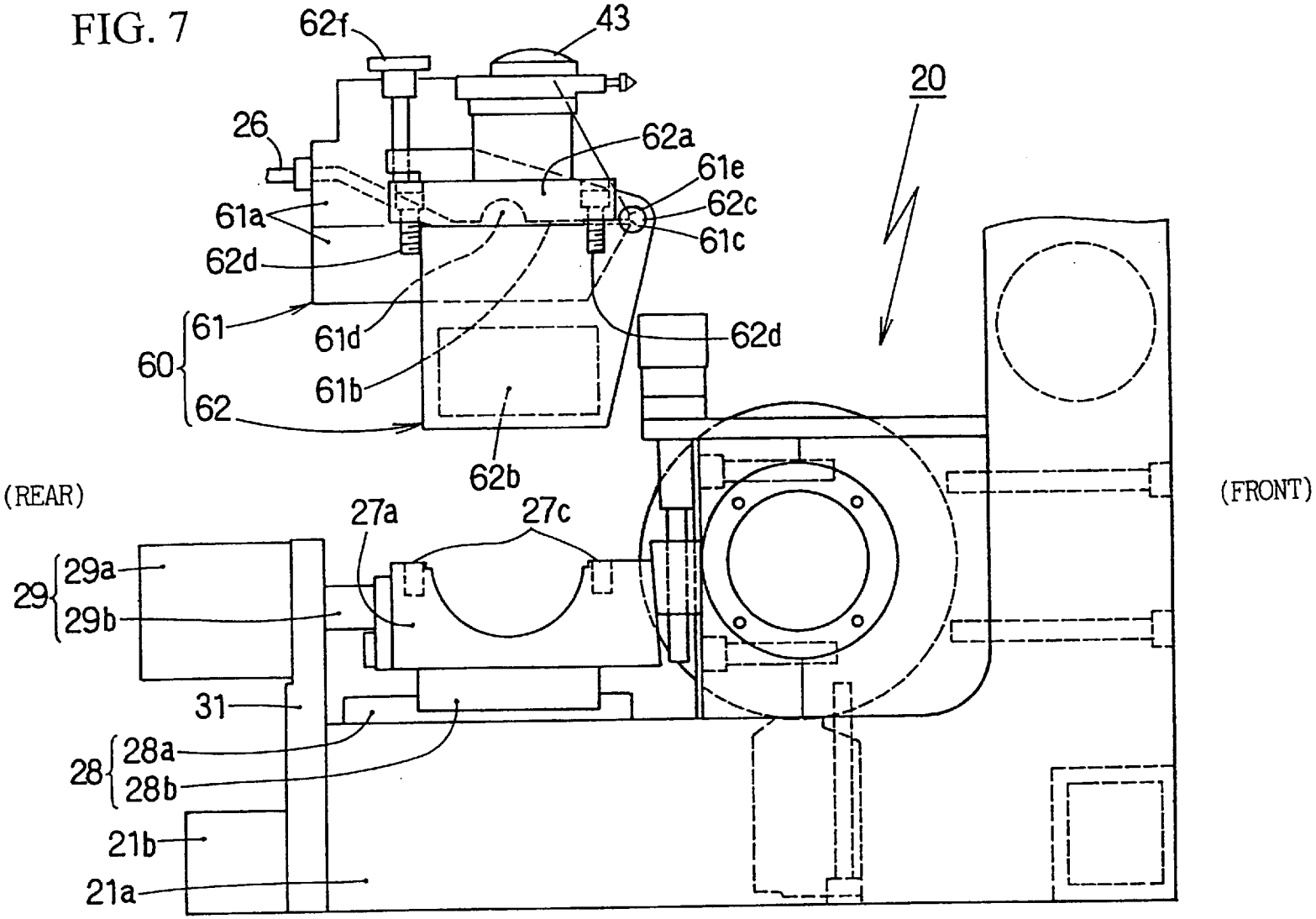
FIG. 7 is a right side view of the first embodiment showing a coating assembly having a die head, which does not rotate during coating, removed from the bearing cases.
Figure 8:
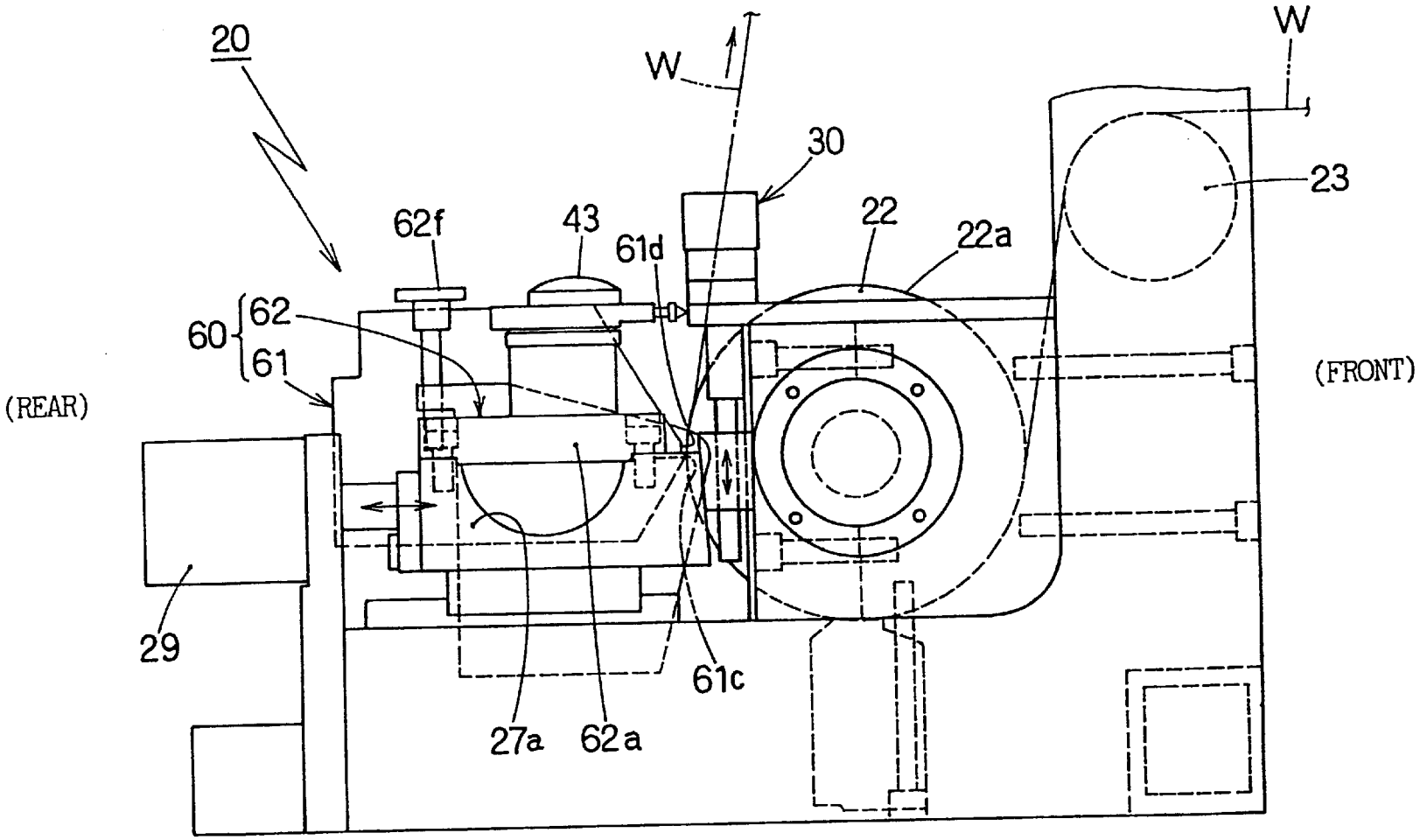
FIG. 8 is a right side view showing the same coating assembly mounted to the bearing cases.
Figure 9:
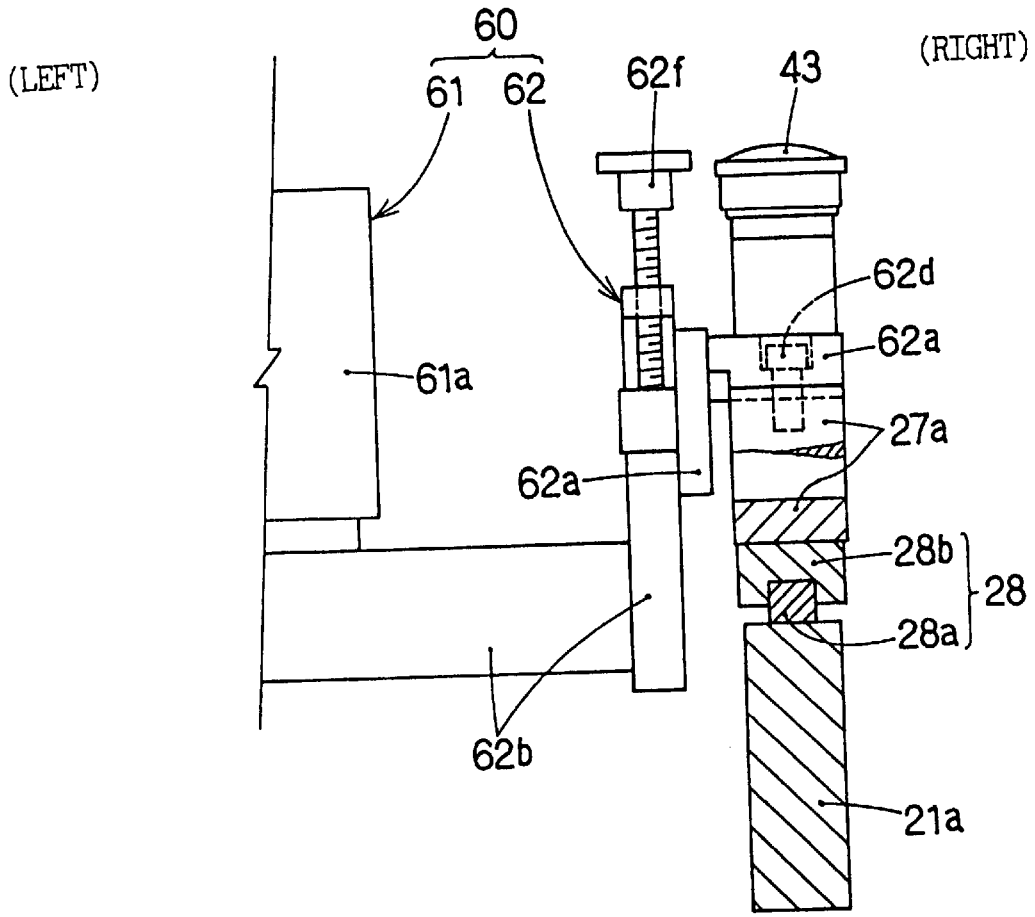
FIG. 9 is a front view showing mounting of a frame of the same coating assembly to a bearing case.
Figure 10:
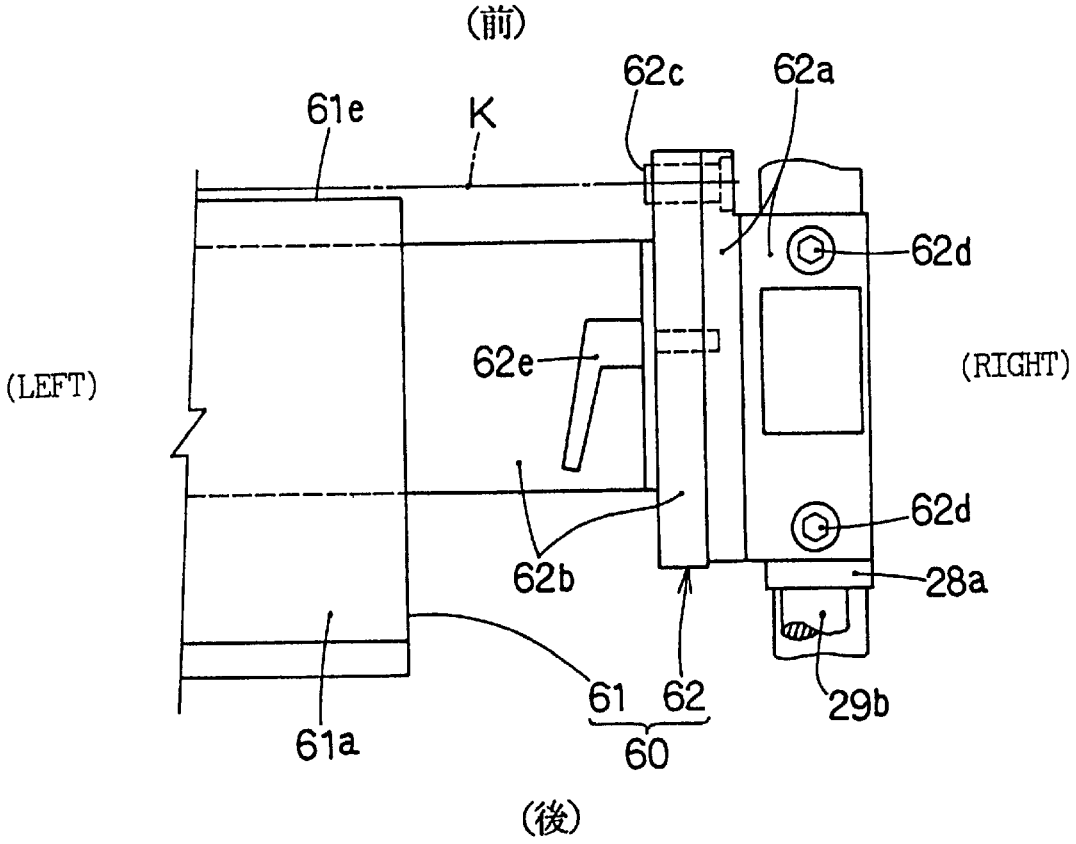
FIG. 10 is a plan view showing mounting of the frame of the same coating assembly to the bearing case.

The coating assembly 60, as shown in FIG. 7 and FIG. 8, has a die head 61, which does not rotate during coating, and a holding assembly 62 for holding the die head 61. The die head 61, as shown in FIG. 7, has a coating liquid passage 61*b* provided inside a die body 61*a*, a coating liquid delivery slit 61*c* extending in the left-right direction at the downstream end of the coating liquid passage 61*b*, a metering lip 61*e* at an edge of the coating liquid delivery slit 61*c*, and a manifold 61*d* formed part-way along the coating liquid passage 61*b*, and coating liquid supplied through a coating liquid supply hose 26 connected to the upstream end of the coating liquid passage 61*b* is delivered through the coating liquid delivery slit 61*c* to the face 22*a* of the backing roller 22. Coating liquid delivered through the slit 61*c* is coated onto the surface of a web W (see FIG. 2) being carried by the face 22*a* of the backing roller 22 and is post-metered by the metering lip 61*e* and becomes a coated film of constant thickness.

The holding assembly 62 has left and right mounting parts 62*a* removably fixable to the bearing cradle parts 27*a* of the left and right bearing cases 27, a holding part 62*b* connected to the body 61*a* of the die head 61, left and right pins 62*c* pivotally connecting the holding part 62*b* to the left and right mounting parts 62*a*, left and right screws with handles 62*e* (see FIG. 10) for fixing the holding part 62*b* with respect to the left and right mounting parts 62*a*, left and right angle-adjusting handles 62*f* disposed between the left and right mounting parts 62*a* and the holding part 62*b* for adjusting the angle of the holding part 62*b*, and bolts 62*d*, 62*d* passing through the left and right mounting parts 62*a*. The centerline K (see FIG. 10) of the left and right pins 62*c* passes about the tip position of the metering lip 61*e*.

The coating assembly 60 is installed on the support frame 21 by the mounting parts 62*a* of the holding assembly 62 being brought into abutment with the bearing cradle parts 27*a* of the left and right bearing cases 27 and the bolts 62*d* being screwed into the threaded holes 27*c* in the bearing cradle parts 27*a*, and can be removed from the support frame 21 by the mounting parts 62*a* being detached from the bearing cradle parts 27*a* of the bearing cases 27. When installed on the support frame 21, as shown in FIG. 8, the coating assembly 60 coats coating liquid delivered through the coating liquid delivery slit 61*c* of the die head 61 onto the web W being transported by the backing roller 22 and with the metering lip 61*e* of the die head 61 post-meters the coating and thereby forms a coated film of a predetermined thickness. Adjustment of the thickness of the coated film is carried out by operating the gap adjusters 30 while looking at the dial gauges 43 attached to the bearing cases 27. The coating assembly 60 can be brought to an optimum angle for producing a good surface state of the coated film by the angle of the die head 61 being adjusted by operation of the left and right screws with handles 62*e* and the left and right angle-adjusting handles 62*f*.

In the coating apparatus 20, by the shaft parts 41*a*, 41*a* (or 51*a*, 51*a*) of the coating assembly 40 (or 50) being set/removed in/from the left and right bearing cases 27 mounted on the support frame 21 or by the mounting parts 62*a* of the coating assembly 60 being fixed/detached to/from the bearing cradle parts 27*a* of the bearing cases 27 with the bearing cover parts 27*b* removed, the coating assemblies 40, 50 and 60 can be interchanged with respect to the bearing cases 27. And in the coating apparatus 20, as a result of two sets of bearing cases 27 mounted on the support frame 21 being used commonly, it becomes unnecessary for the coating assemblies 40, 50, 60 to be provided with bearing cases and mounting fittings, and thus the coating assemblies 40, 50, 60 can be made smaller and lighter. Also, with the coating apparatus 20, because slider mechanisms 28 for allowing the bearing cases 27 to slide are provided on the support frame 21, sliding adjustment of the coating assembly 40, 50 or 60 mounted on the bearing cases 27 is possible without it being necessary for a sliding mechanism to be provided on each of the coating assemblies 40, 50, 60.

Although the coating apparatus 20 described above has a construction wherein the left and right ends of the coating assemblies 40, 50, 60 are both supported on bearing cases 27 mounted on the left and right side frame members 21*a*, 21*a* of the support frame 21, this is not because of any particular limitation, and, while it is not illustrated in the drawings, it is also possible of course to adopt a cantilever support structure wherein two sets of bearing cases 27 are provided on one side of the support frame only and one side of the coating assembly 40, 50, 60 only is supported by the bearing cases 27.

SECOND PREFERRED EMBODIMENT

Figure 11:
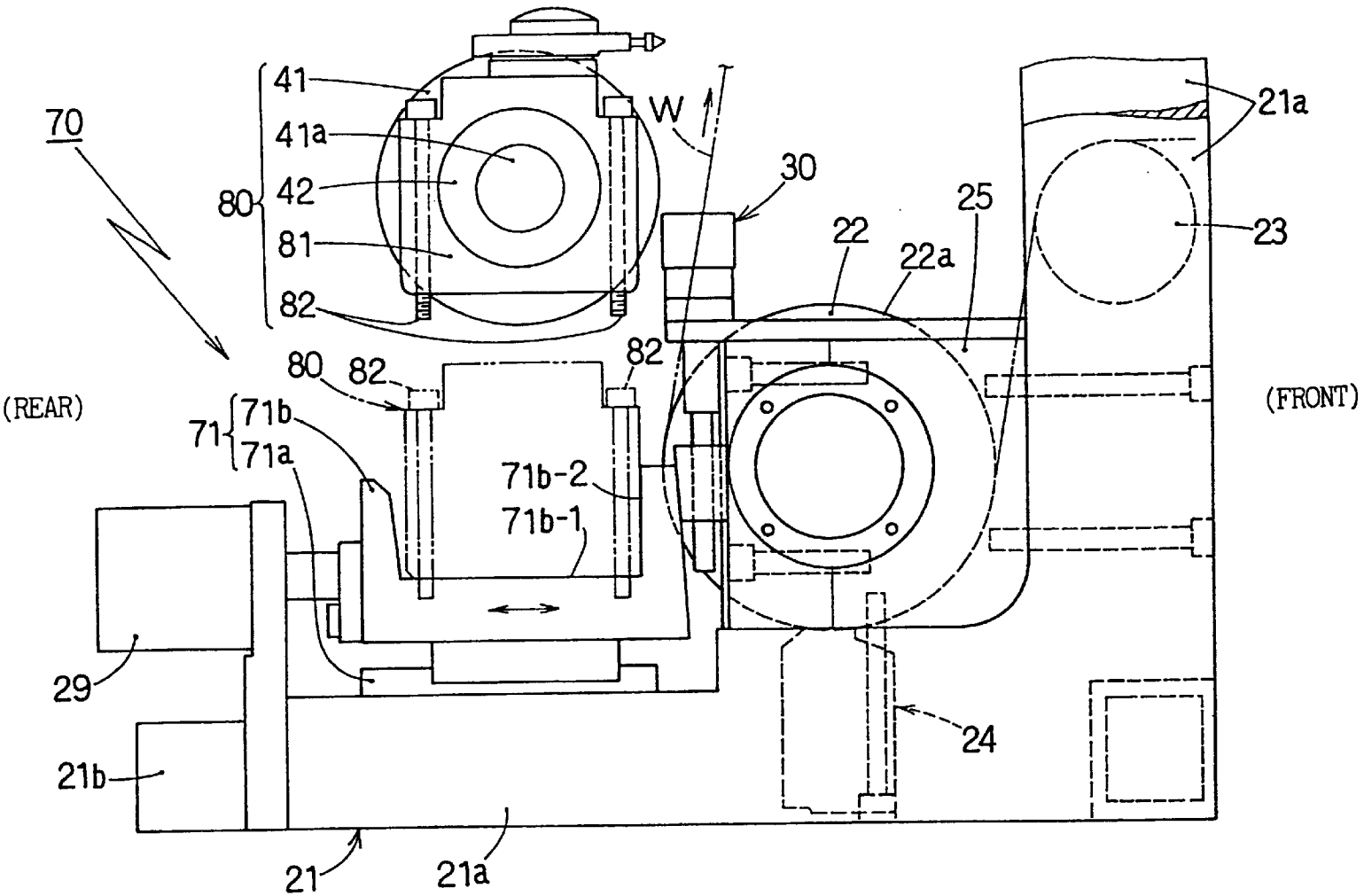
FIG. 11 is a right side view of a second preferred embodiment of a coating apparatus according to the invention and shows with solid lines a coating assembly having a metering roller removed from sliders and with dashed lines the same coating assembly in an installed state.
Figure 12:
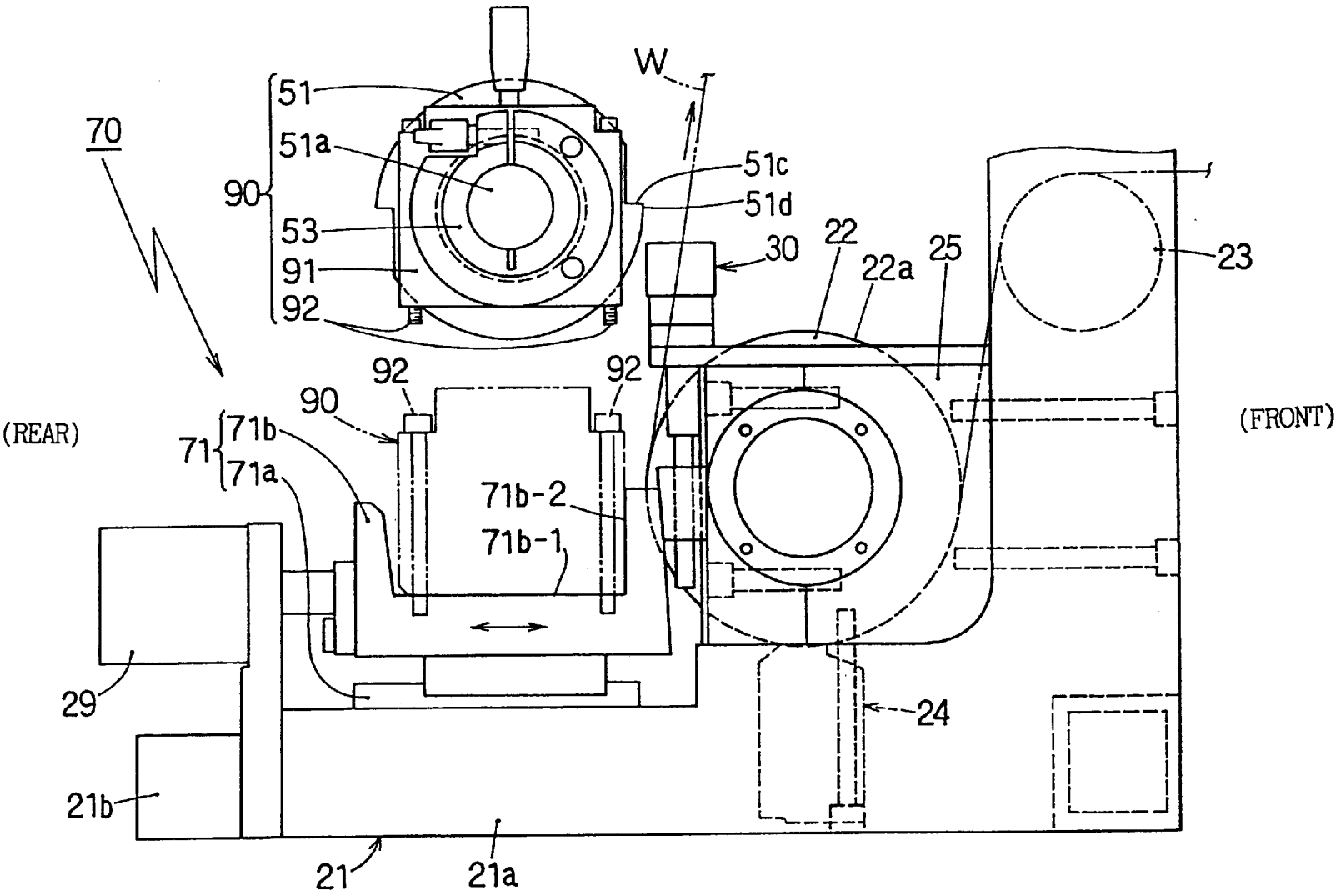
FIG. 12 is a right side view of the second embodiment showing with solid lines a coating assembly having a doctor knife removed from the sliders and with dashed lines the same coating assembly in an installed state.
Figure 13:
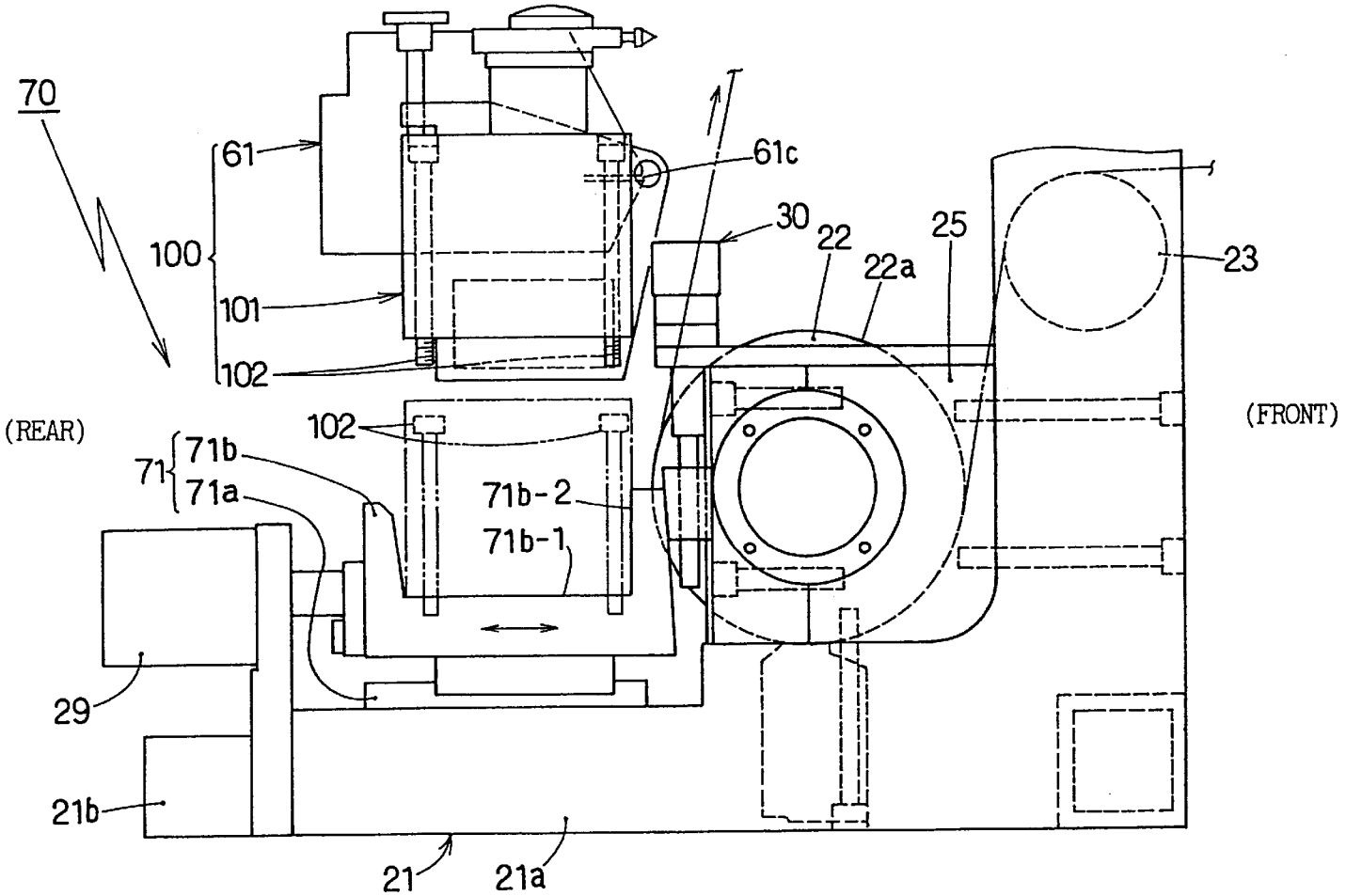
FIG. 13 is a right side view of the second embodiment showing with solid lines a coating assembly having a die head removed from the sliders and with dashed lines the same coating assembly in an installed state.
Figure 14:
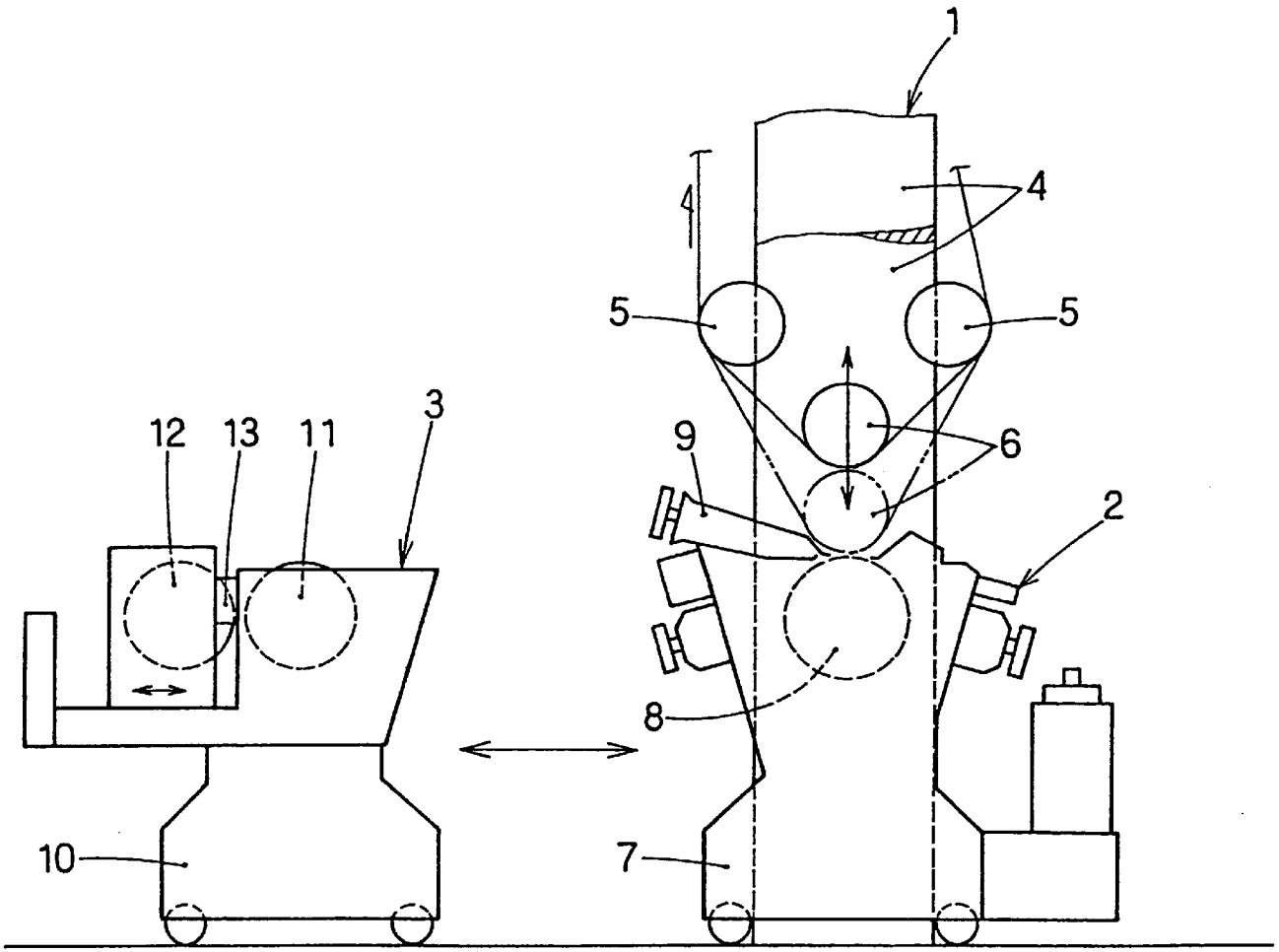
FIG. 14 (PRIOR ART)
FIG. 14 is a right side view of a coating apparatus in related art.

FIG. 11 through FIG. 13 show a second preferred embodiment of the coating apparatus of the invention.

The coating apparatus 70 of this preferred embodiment has a plurality of coating assemblies 80, 90, 100 which can be interchangeably installed to a support frame 21, left and right slider mechanisms 71 having left and right sliders 71*b* slidable with respect to the support frame 21, and left and right gap adjusters 30 for adjusting stopping positions of the left and right sliders 71*b*. Frames 81, 91 and 101 of the coating assemblies 80, 90, 100 can be removably mounted to the left and right sliders 71*b*. Each of the left and right slider mechanisms 71 is made up of a guide rail 71*a* fixed to the side frame member 21*a* of the support frame 21 and a slider 71*b* slidably guided on the guide rail 71*a*, and each of the sliders 71*b* is moved in the front-rear direction by an actuator 29 consisting of an air cylinder or the like. The sliders 71*b* are each provided with a setting face 71*b*-1 and a vertical face 71*b*-2 so that the frame 81, 91, 101 of the coating assembly 80, 90, 100 can be placed in position.

As shown in FIG. 11, the coating assembly 80 has a metering roller 41, which rotates during coating; bearings 42, consisting of ball bearings or the like, fitted to left and right shaft parts 41*a* and 41*a*; left and right frames 81 holding the bearings 42; and bolts 82, 82 passing through the left and right frames 81. The coating assembly 80 is installed to the support frame 21 by the left and right frames 81 being placed on the left and right sliders 71*b* in a positioned state as shown with dashed lines in the figure and fixed there by the bolts 82, 82 being screwed into the sliders 71*b*, and can be removed from the support frame 21 as shown with solid lines in the figure by the bolts 82, 82 being unscrewed. When installed on the support frame 21, in the same way as the coating assembly 40 the coating assembly 80 post-meters with the metering roller 41 a coated film formed by the fountain applicator 24 on the web W and thereby brings the film to a predetermined film thickness. Adjustment of the thickness of the coated film is carried out by operating the gap adjusters 30 while looking at dial gauges 43 attached to the frames 81.

The coating assembly 90, as shown in FIG. 12, has a doctor knife 51, which is fixed and does not rotate during coating; bearings 52 (see FIG. 6) fitted to left and right shaft parts 51*a*, 51*a* of the doctor knife 51; left and right frames 91 holding the bearings 52; bolts 92, 92 passing through the frames 91; and a fixing assembly 53, which can be fitted and tightened onto the shaft part 51*a* on an operating side and anchored to the frame 91 on that side. The doctor knife 51 and the fixing assembly 53 are constructed in the same way as in the first preferred embodiment. The coating assembly 90 is installed to the support frame 21 by the frames 91 being placed on the left and right sliders 71*b* in a positioned state and fixed there with the bolts 92, 92 and can be removed from the support frame 21 by the bolts 92, 92 being unscrewed. When installed on the support frame 21, in the same way as the coating assembly 50, the coating assembly 90 post-meters with the doctor knife 51 a coated film formed by the fountain applicator 24 on the web W and thereby brings the film to a predetermined film thickness. Adjustment of the thickness of the coated film is carried out by operating the gap adjusters 30 while looking at dial gauges 43 attached to the frames 91.

The coating assembly 100, as shown in FIG. 13, has a die head 61, which is fixed and does not rotate during coating; left and right frames 101 holding the die head 61; and bolts 102, 102 passing through the frames 101. The left and right frames 101, as in the first preferred embodiment, have mechanisms for adjusting the angle of the die head 61. The coating assembly 100 is installed to the support frame 21 by the frames 101 being placed on the left and right sliders 71*b* in a positioned state and fixed there with the bolts 102, 102, and can be removed from the support frame 21 by the bolts 102, 102 being unscrewed. When installed on the support frame 21, in the same way as the coating assembly 60, the coating assembly 100 delivers coating liquid through the coating slit 61*c* toward the face 22*a* of the backing roller 22 and thereby forms a coated film of a constant thickness on the surface of the web W (see FIG. 2) being carried on the face 22*a* of the backing roller 22.

In the coating apparatus 70, by the frames 81, 91, 101 of the coating assemblies 80, 90, 100 being mounted/removed to/from the sliders 71*b* mounted on the support frame 21, the coating assemblies 80, 90, 100 can be interchanged. Also, with the coating apparatus 70, because the coating assemblies 80, 90, 100 use the slider mechanisms 71 and the gap adjusters 30 commonly, it becomes unnecessary for the coating assemblies 80, 90, 100 to be provided with slider mechanisms 71 and gap adjusters 30, and the coating assemblies 80, 90, 100 can be made lighter.

Although the coating apparatus 70 described above has a construction wherein the left and right ends of the coating assemblies 80, 90, 100 are both supported on sliders 71*b* mounted on the left and right side frame members 21*a*, 21*a* of the support frame 21, this is not because of any particular limitation, and, while it is not illustrated in the drawings, it is also possible of course to adopt a cantilever support structure wherein sliders 71*b* are provided on one side of the support frame only and one side of the coating assembly 80, 90, 100 only is supported by the sliders 71*b*.

As described above in detail, with a coating apparatus according to the invention, by commonizing parts and reducing the number of parts and thereby decreasing the size and weight of the coating assemblies, it is possible to reduce storage space, facilitate handling, and cut the overall manufacturing cost of the apparatus.

Also, because fixing of a coating assembly which does not rotate during coating can be carried out surely and adjustment of the rotational position of the coating assembly can be carried out when coating is not in progress, smooth coating work is possible.

Also, interchanging of coating assemblies can be carried out by joining and separation of bearing cradle parts and bearing cover parts, and changes of coating mode can be carried out quickly.

Also, because a coating assembly can be mounted to and removed from bearing cases by mounting parts of the coating assembly being fixed to bearing cradle parts with their bearing cover parts removed, interchanging of coating assemblies not having shaft parts with respect to bearing cases can be carried out and changes of coating mode can be made quickly.

Further, because as a result of the sliding mechanisms being used commonly by the coating assemblies it becomes unnecessary for the coating assemblies to have sliding mechanisms, overall manufacturing cost can be reduced.

Furthermore, as a result of the size and weight of the coating assemblies being reduced by the sliders and gap adjusters being made common and the number of parts being reduced, the coating assemblies require less storage space and are easier to handle and the manufacturing cost of the apparatus as a whole can be cut further.

What is claimed is:

1. A coating apparatus wherein a plurality of coating assemblies can be interchangeably installed to a support frame, comprising:

a support frame;

two bearing cases mounted on the support frame; and a coating assembly which rotates during coating and a coating assembly which does not rotate during coating, the coating assemblies each having two shaft parts which can be removably set in the bearing cases, wherein the shaft parts of the coating assembly which rotates can be set in the bearing cases rotatably and the shaft parts of the coating assembly which does not rotate, when set in the bearing cases, can be anchored to a fixed part so that they cannot rotate.

2. A coating apparatus according to claim 1, wherein the coating assembly which does not rotate has a fixing assembly which can be fitted and tightened on one of the shaft parts of that coating assembly and anchored to a fixed part of the respective bearing case, and when the fixing assembly is tightened, the coating assembly which does not rotate cannot rotate and, when the fixing assembly is not tightened, the coating assembly which does not rotate can be rotationally adjusted.

3. A coating apparatus according to claim 2, wherein the bearing cases each have a bearing cradle part mounted on the support frame and a bearing cover part separably joined to the bearing cradle part and the shaft parts of the coating assemblies can be held by the bearing cradle parts and the bearing cover parts in their joined state.

4. A coating apparatus according to claim 2, wherein the bearing cases are mounted on sliders provided slidably on the support frame.

5. A coating apparatus according to claim 1, wherein the bearing cases each have a bearing cradle part mounted on the support frame and a bearing cover part separably joined to the bearing cradle part, and the shaft parts of the coating assemblies can be held by the bearing cradle parts and the bearing cover parts in their joined state.

6. A coating apparatus according to claim 5, further comprising another coating assembly which does not rotate during coating, this coating assembly having mounting parts which can be removably fixed to the bearing cradle parts.

7. A coating apparatus according to claim 6, wherein the bearing cases are mounted on sliders provided slidably on the support frame.

8. A coating apparatus according to claim 5, wherein the bearing cases are mounted on sliders provided slidably on the support frame.

9. A coating apparatus according to claim 1, wherein the bearing cases are mounted on sliders provided slidably on the support frame.

10. A coating apparatus wherein a plurality of coating assemblies can be interchangeably installed to a support frame, comprising:

a support frame;

sliders provided on the support frame so as to be able to advance and retreat;

a gap adjuster for adjusting stopping positions of the sliders; and a plurality of coating assemblies each having frames which can be removably fixed to the sliders.

* * * * *